US005184963A

United States Patent [19]

Ishikawa

[11] Patent Number: 5,184,963

[45] Date of Patent: Feb. 9, 1993

[54] ELECTRICAL CONNECTOR WITH CONTACTS ON DIESTAMPING CENTERS

[75] Inventor: Shigeru Ishikawa, Hachioji, Japan

[73] Assignee: AMP Incorporated, Harrisburg, Pa.

[21] Appl. No.: 771,075

[22] Filed: Oct. 2, 1991

[30] Foreign Application Priority Data

Oct. 26, 1990 [JP] Japan ..... 2-287136

[51] Int. Cl.[5] ..... H01R 9/09

[52] U.S. Cl. ..... 439/79; 439/554; 439/567; 439/752

[58] Field of Search ..... 439/76, 79-81, 439/352, 554, 564, 567, 573, 689, 708, 722-724, 752, 885

[56] References Cited

U.S. PATENT DOCUMENTS 4,274,691 6/1981 Abernethy et al. ..... 439/554

5,080,611 1/1992 Hypes ..... 439/567

FOREIGN PATENT DOCUMENTS 2-72570 12/1990 Japan .

*Primary Examiner*—Paula A. Bradley

*Attorney, Agent, or Firm*—Adrian J. LaRue

[57] ABSTRACT

An electrical connector (30) and a method of making includes a base housing (40) holding contacts (41) on close spacing and a face housing (50) fitted onto the base housing to protect the contacts. The base housing (40) includes an alignment post (46) integrally formed with the contacts as intercoupled by a carrier section to tie the contact position and alignment post position together dimensionally. The alignment post includes a slot (45) receiving a fastener (35) fitted therein with barbs (37) projecting outwardly to latch the post and thereby the base and face housings to a printed circuit board for surface mounting to the traces of the board.

8 Claims, 3 Drawing Sheets

ELECTRICAL CONNECTOR WITH CONTACTS ON DIESTAMPING CENTERS

This invention relates to an electrical connector and method of making such connector; and more specifically to a connector and method for use on a printed circuit board (PCB) wherein contacts are insert molded with the contacts intercoupled on the pitch of stamping and with an alignment post integrally formed with the housing during insert molding.

BACKGROUND OF THE INVENTION

As various electronic apparatus has become more compact and available, areas on PCB's have become more restricted, needs to provide contacts for higher densities have developed. In recent consumer electronic appliances and devices for office automation it has developed that connectors are needed wherein contacts in substantial number, twenty or more, having a 0.5 mm to 0.635 mm center line pitch with 1 mm or lower spacing between contacts in adjacent rows are necessary.

An example of such requirements is disclosed in, for example, the Japanese patent application number 72570/90, now open as a publication. FIGS. 6 and 7 of this application, labeled herein as prior art, illustrate such connector to include a base housing 11 retaining a plurality of contacts 17 in two rows, upper and lower, and a cap or face housing 10 to be assembled integrally with the base housing 11 for protecting the contacts. The face housing includes screw holes 22 for mounting the assembled electrical connector on a panel, a PCB or the like. Both housings 10 and 11 are molded from a suitable engineering plastic material and the face housing is assembled as an integral part with the base housing by inserting the latching arms 18 thereof into latching openings 12 of the face housing. In molding the two housings which must intermate, the positioning of contacts in the base housing can be critical to the tolerances of such housings, particularly in the miniature and high density electrical connectors with 1 mm or shorter contact pitches as mentioned above. Additionally, this fine pitch of contacts and the line width on printed circuit boards to which the connectors must be connected make the alignment of the arrays of contacts quite critical, particularly in the very fine pitch applications heretofore mentioned.

Accordingly it is an object of the present invention to provide a miniature, high density electrical connector particularly suited for PCB mounting with 1 mm or less contact pitch. It is a further object to provide a method of making a connector wherein pitches of 1 mm or less are contemplated. It is still a further object to provide an electrical connector having high density electrical contacts wherein the alignment between contacts and a connector housing is assured.

SUMMARY OF THE INVENTION

The electrical connector according to the present invention retains a plurality of contacts in a base housing at a constant spacing and includes an alignment post formed integrally with the base housing at at least one end thereof.

In making the connector, contacts are intercoupled to a so-called carrier at at least one end thereof and are insert molded into the base housing. Simultaneously, one or more alignment post is formed with the base housing. As a result, the position of each contact is accurately determined with respect to the base housing and also directly determined with respect to the alignment post. Subsequently, a face housing is assembled to the base housing to protect the contacts as mounted and carried by the base housing. It is to be noted that the position of each contact with respect to a printed circuit board is directly determined by virtue of the alignment post integral with the base into which the contacts are molded rather than indirectly by way of the face housing and hardware thereon. The contacts carry die stamping tolerances into the assembly.

Additionally, the alignment housings are made to include slots therein extending along the length thereof and fasteners in the form of stampings having resilient spring sections and projections such as barbs are fitted therein to extend therefrom to fasten the connector in position relative to holes in a printed circuit board or the like.

The invention embraces additionally interdigitating contacts as stamped with the carriers or intercoupling sections overlapped to place the contacts on very close centers with one end thereof, the contact ends overlapping to form two rows of contacts and with the other ends forming surface mounting sections arranged in the same plane for soldering to the circuit traces of a printed circuit board.

IN THE DRAWINGS

DETAILED DESCRIPTION OF THE INVENTION

Figure 1:
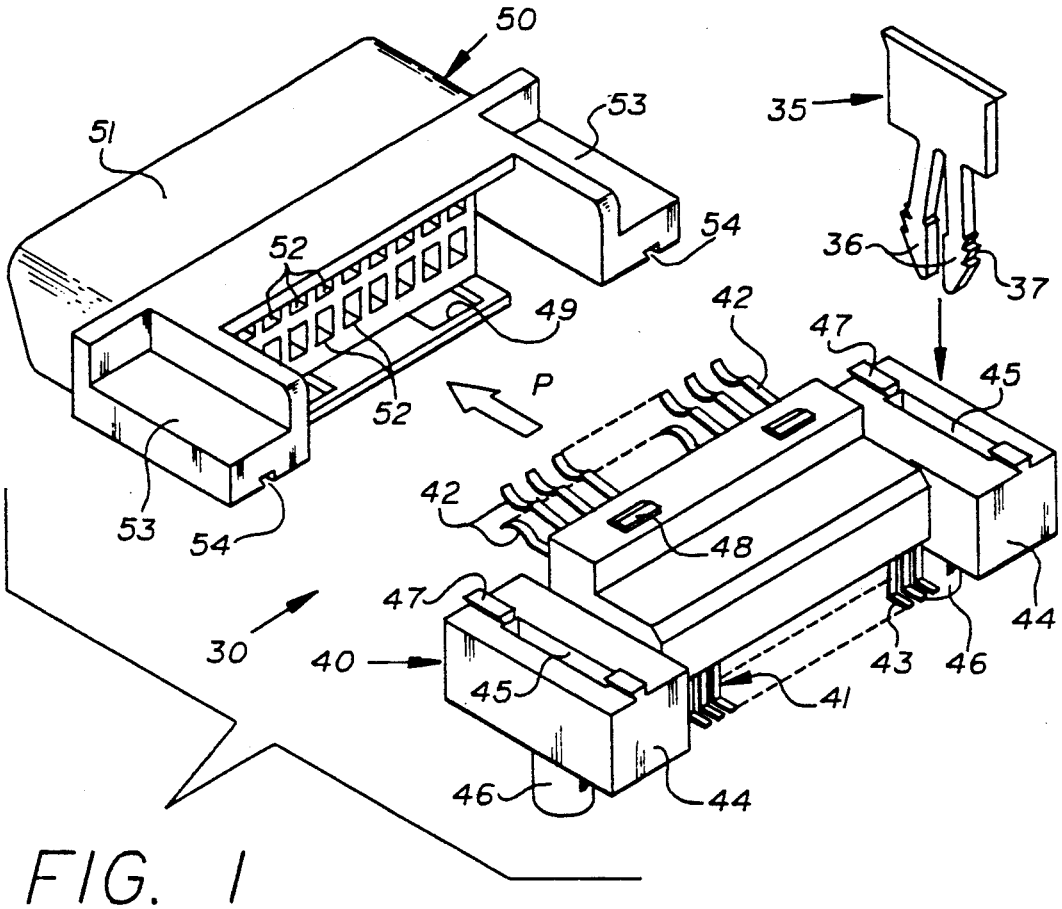
FIG. 1 is an exploded perspective view of an embodiment of a receptacle type of electrical connector in accordance with the present invention.

Referring now to FIG. 1 there is illustrated in an exploded perspective view an embodiment of a receptacle type electrical connector in accordance with the present invention. The connector 30 is a two piece structure including a base housing 40 and a face housing 50. The base housing 40 is preferably made by molding insulating material such as a glass-filled polyphenylene sulfide (PPS). The base housing has a plurality of contacts or terminals 41 comprising receptacle contact sections 42 in upper and bottom rows at the front or mating end of the housing and surface mount (SMT) terminal sections 43 at the rear end in a common plane. At both ends, there are formed block members 44 integral with the housing having slots 45 extending therein and additionally having dovetail engaging projections 47 in or on the upper central surface of each block member. Substantially circular alignment posts 46 are formed on the bottom surfaces of the block members to project down from the body of the base housing 40. The slots 45 continue from the upper surface of the blocks well down into the posts 46 to accommodate a fastener 35 having a pair of resilient legs 36 formed therein. The fastener 35 is made by stamping a resilient sheet metal material into the profile shown. Each of the resilient legs of fastener 35 includes a series of barbs 37 projecting outwardly therefrom and the fastener is given a dimension so that the barbs 37 protrude from the lower portions of slots 45 in the manner shown in FIG. 2.

Although not shown it is to be understood that the connector formed of base housing 40 and face housing 50 and the contacts contained thereby are mounted on a printed circuit board by extending the posts 46 through holes or apertures in such board, the holes being related dimensionally to traces on the upper surface of the board that are to be inter- connected by the connector. As shown in FIG. 1, the plurality projections 48 are formed on the upper and bottom front ends of the base housing 40 for engaging with the shoulders 49 of the face housing 50 and retaining the housings together.

The face housing 50 is preferably made by molding, for example, a liquid crystal polymer material to include a D-shaped hood section 51 projecting and formed on the front face of the housing. Two rows of contact-receiving cavities 52 are formed through the face housing extending from the rear surface toward the front surface separated by vertical walls. When the housings 40 and 50 are mated together a contact section 42 of each contact 41 passes into a cavity 52 and is isolated from adjacent contact sections by the walls therebetween. Flat plate sections 53 are formed at both sides of the face housing 50 to correspond with the upper surfaces of block members 44 of the base housing 40. Dovetailed grooves 54 are formed in the bottom surfaces of plate sections 53 dimensioned to receive the dovetail projections 47 of base housing 40.

In order to assemble and integrate the housings 40 and 50, the fasteners 35 are pressed into slots 45 of the base housing 40 fully down within the slots to a point of clearing the dovetail projections 47. Thereafter the housings are brought together by inserting the dovetail projections 47 of housing 40 into the grooves 54 in the face housing 50 in the direction represented by arrow P in FIG. 1. Assembly is complete when the latch projections 48 of housing 40 engage against shoulders 49 in the inner wall of face housing 50 as shown in FIG. 2.

Figure 2:
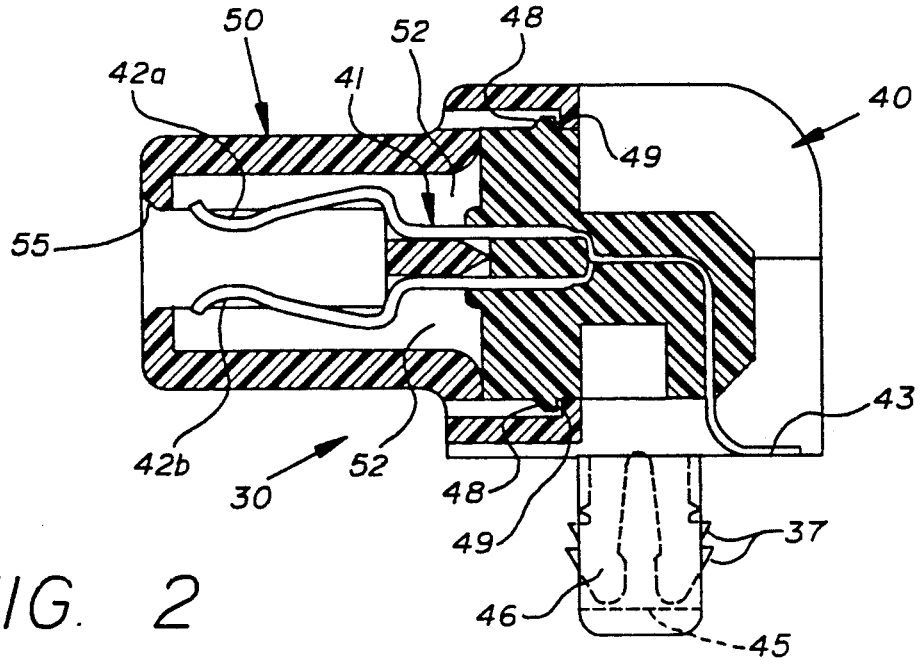
FIG. 2 is a cross-sectional view of the assembled connector of FIG. 1.

Also illustrated in FIG. 2 through the cross-sectional view of a receptacle type electrical connector 30 is the assembly of housings 40 and 50 as a unitary member. As can be appreciated from FIG. 2, the contact sections 42 of contacts 41 are disposed alternately in upper and bottom rows 42*a* and 42*b*. A plug housing or an edge of a printed circuit board having contact pads can be mated with the connector 30 by being inserted between the rows 42*a*, and 42*b*. The face housing 50 includes an opening 55 at the front surface adapted to receive the insertion of a mating plug housing or printed circuit board or the like. Face housing 50 is slidably assembled to the base housing to maintain proper isolation between the adjacent contacts and protect the contacts 41 from damage or degradation in performance due to external shock or dust.

Figure 3:
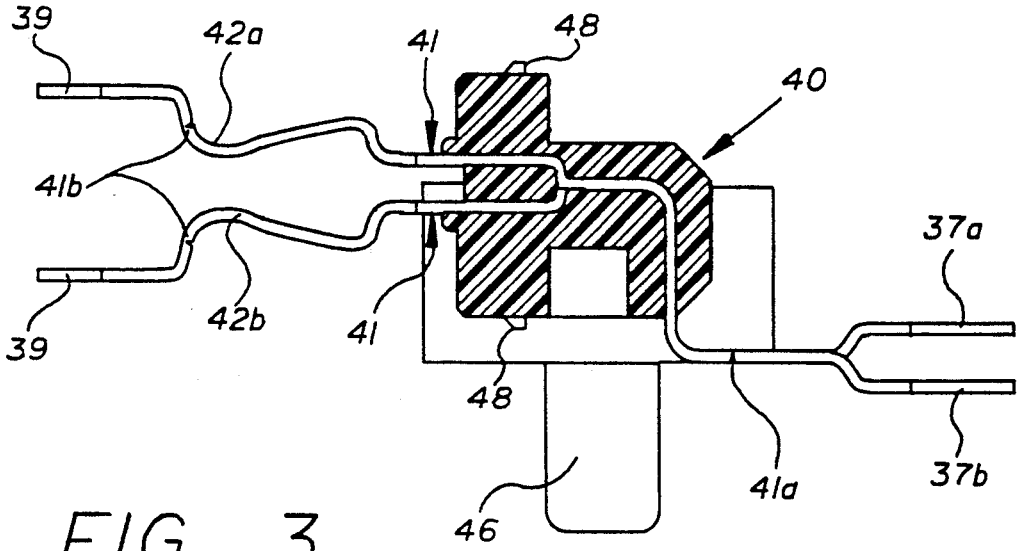
FIG. 3 is a cross-sectional view of the base housing and contact assembly of the invention.
Figure 4:
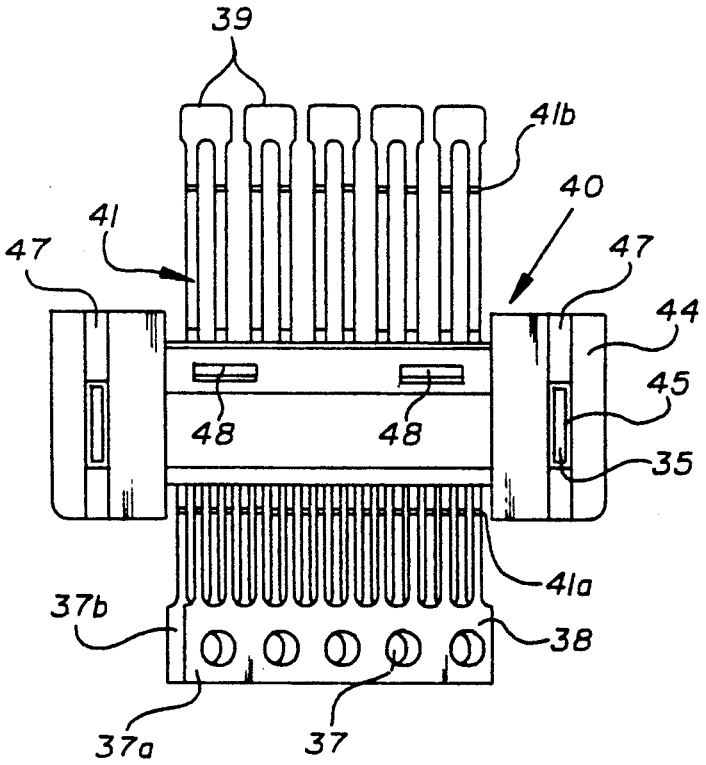
FIG. 4 is a top plan view of FIG. 3 showing the method of the invention in relation to the presence of intercoupling sections for the contacts.

FIGS. 3 and 4 show the steps of making the receptacle type electrical connector 30, particularly the base housing 40 thereof which is illustrated in FIG. 1. In FIG. 3 a cross-sectional view of the housing 40 is shown with a top plan view of such housing shown in FIG. 4. To be noted is the arrangement of contacts 41 in the form of two carrier strips which are laid one over the other in an interdigitated manner to form alternate contacts which can be positioned in two separate rows, forming the contact rows 42*a* and 42*b* at the contacting end thereof. As can be seen in FIG. 4 the carrier strips 38 which form intercoupling sections 37*a* and 37*b* are laid one over the other and spaced apart as shown in FIG. 3. As can also be discerned in FIGS. 3 and 4 while every other contact of the connector housing is associated with a common carrier strip 37*a* or 37*b* the opposite ends of the contacts are interconnected by intercoupling sections 39 intercoupling an adjacent pair of contacts.

Figure 6:
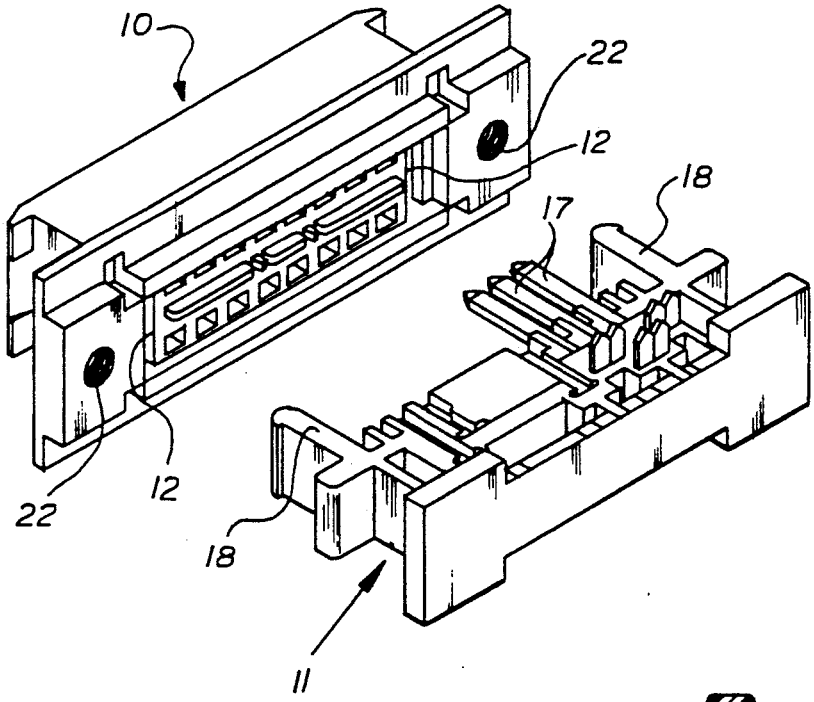
FIG. 6 PRIOR ART
FIGS. 6 and 7 are exploded perspective and cross-sectional views of a connector in accordance with the prior art.
Figure 7:
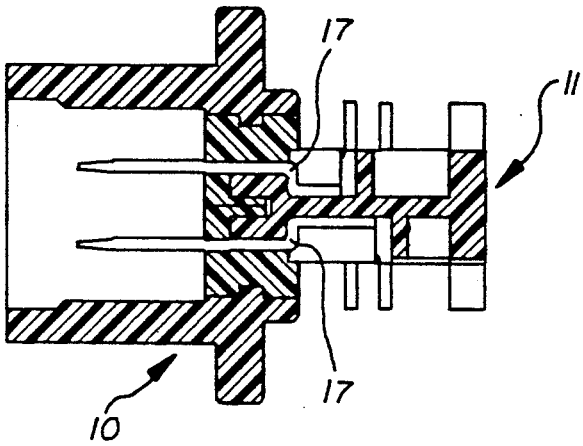

In order to maintain alignment during insert molding, the contacts are kept on the centers as stamped by the carriers 37*a* and 37*b* and intercoupled as at 39. The carriers include index holes 37*c* as shown in FIG. 4. These holes facilitate laying the contacts in a jig or fixture which is in turn placed into an insert mold or formed in the mold to allow insert molding of the housing 40. After insert molding, the contacts including the carriers and the coupling sections are bent so that reliefs shown as 41*a* and 41*b* at the rear and front of the contacts respectfully allow removal of the intercoupling sections by either cutting or bending so that the contact material breaks at such reliefs. This will leave a substantial number of contacts 41 as shown in FIGS. 1 and 2 on the precise dimensional spacing as die stamped. Moreover since the contacts are insert molded and the posts 46 and slots 45 therein are integrally formed, the posts 46 will be aligned with the contacts precisely. Also to be appreciated, the tie-in dimensionally of posts 46 to the positioning of the contacts in the several rows of contacts differs from the prior art wherein the alignment of the connector is dependent upon holes and mountings associated with the face housing, as shown by housing 10 in FIG. 6.

Also to be noted in FIGS. 1 and 2 is the flat area 43 formed at the rear end of each contact which serves to provide a surface mounting by soldering to a trace on a printed circuit board. The areas 43 may be pretinned or coated with solder so as to allow reflowing by any number of available processes to the circuit traces of a board once the housings of the connector are mounted on such board by inserting posts 46 in holes in such board to a point where the projections on barbs 37 engage the board material.

Figure 5:
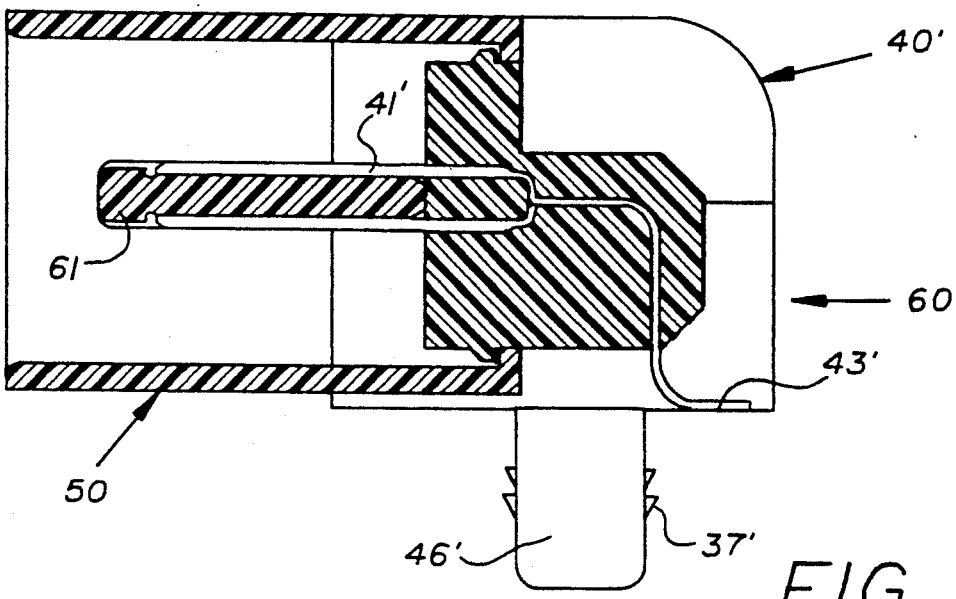
FIG. 5 is a cross-sectional view of a plug type of electrical connector in accordance with the invention.

FIG. 5 shows a cross-sectional view of a connector similar to that described but with a plug type connector 60 made to include a base housing 40' and a face housing 50' with the face housing including a central divider portion 61 in the matter shown and with the contacts 41' having flat portions which are positioned dimensionally to fit within the contacts 41 of the receptacle housing, engaging respectively the contact sections 42 of the receptacle half as shown in FIGS. 1 and 2. As can be discerned from FIG. 5 the plug half 60 would include alignment posts 46' and resilient legs carrying barbs 37' in the same manner as described with respect to the receptacle half.

It is also contemplated that either half may be surface mounted in the manner described with the other half given a different sort of termination to either flat flexible circuits or to discreet wires utilizing a suitable interconnection in lieu of the flat sections 43.

It is also contemplated that both plug and receptacle connector halves may be manufactured by insert molding tying the dimensioning of the contacts to the positioning of alignment posts 46.

Indeed the invention fully contemplates that the contacting sections of the contacts may be arranged in numbers of rows rather than two rows and that the terminal sections may be other than SMT. Additionally, the use of the retention legs of the fasteners with respect to the alignment posts is preferable but may be substituted by other means for retaining the connector in position prior to undergoing soldering.

According to the present invention the ability to achieve high density electrical contacts having contacts on 1.0 mm center line pitch or down to 0.05 mm center line pitch for both rows of contacts is made possible.

Having now described the invention intended to enable a preferred practice in its preferred modes claims are appended which define the invention:

1. An electrical connector, comprising:

a base housing having electrical contacts secured therein at a specified pitch, said contacts including contact sections extending outwardly from a front surface of said base housing and termination sections extending outwardly from another surface of said base housing;

a post extending outwardly from a bottom surface of said base housing, said base housing having a slot extending therethrough and into said post;

a fastener secured in said slot and having resilient legs disposed in said post and including barbs extending outwardly from said post;

a face housing having contact-receiving cavities in which said contact sections are disposed upon said face housing being assembled to said base housing; and means to secure said base housing to said face housing.

2. An electrical connector as claimed in claim 1, wherein said securing means include latch projections on said base housing engagable with shoulders on said face housing.

3. An electrical connector as claimed in claim 1, wherein said securing means include block members on said base housing and plate members on said face housing which have matable dovetail projection and grooves.

4. An electrical connector as claimed in claim 3, wherein said post is located on one of said block members and said slot extends therethrough so that said plate member thereon covers said fastener.

5. An electrical connector including a base housing having an array of contacts extending therefrom and a face housing adapted to fit onto said base housing with means to cooperatively latch said housings together with the face housing extending over and protecting said contacts, the improvement comprising at least one alignment post projecting from the said base housing to align said housing relative to circuits on a printed circuit board with said post being formed integrally with the base housing and the base housing being formed around the contacts on centers of diestamping to provide a commonality of dimensional reference between the alignment post and said contacts, said post including a slot therein and a fastener inserted in said slot, said fastener including spring legs with barbs resiliently driven to project from said post to latch said housing and connector to a printed circuit board.

6. The connector of claim 5 wherein said fastener is a flat metal stamping.

7. The connector of claim 5 wherein said contacts are comprised of two arrays of stamped contacts interdigitated to provide centers in the connector that are half the centers of the contacts as stamped.

8. The connector of claim 5 wherein said contacts include one end projecting from said base housing to provide an interconnection to a further interconnection and the other end arranged in a common plane for surface mounting to a printed circuit board.

* * * * *